US008579224B2

(12) United States Patent
Allwood

(10) Patent No.: US 8,579,224 B2
(45) Date of Patent: Nov. 12, 2013

(54) DEVICE FOR DISPENSING A TELECOMMUNICATION CABLE FROM A REEL

(75) Inventor: Brent David Allwood, Buttaba (AU)

(73) Assignee: ADC GmbH, Berlin (DE)

( * ) Notice: Subject to any disclaimer, the term of this patent is extended or adjusted under 35 U.S.C. 154(b) by 321 days.

(21) Appl. No.: 12/935,237

(22) PCT Filed: Mar. 3, 2009

(86) PCT No.: PCT/EP2009/001487
§ 371 (c)(1),
(2), (4) Date: Dec. 22, 2010

(87) PCT Pub. No.: WO2009/143919
PCT Pub. Date: Dec. 3, 2009

(65) Prior Publication Data

US 2011/0101148 A1 May 5, 2011

(30) Foreign Application Priority Data

May 29, 2008 (AU) ..... 2008902701

(51) Int. Cl.
*B65H 59/04* (2006.01)
*B65H 75/28* (2006.01)

(52) U.S. Cl.
USPC ..... 242/423; 242/580; 242/587.3

(58) Field of Classification Search
CPC ... B65H 49/32; B65H 49/328; B65H 2701/34
USPC ..... 242/170, 171, 422, 423, 423.1, 466, 242/579, 580, 587, 588, 588.2, 588.3, 242/588.6, 590, 596, 596.8, 129, 156, 172, 242/402, 586, 586.3, 587.2, 587.3, 242/125–125.3
See application file for complete search history.

(56) References Cited

U.S. PATENT DOCUMENTS

| | | | |
|---|---|---|---|
| D15,146 | S | 7/1884 | Helmus et al. |
| 2,501,201 | A | 3/1950 | Wilcox |
| D200,791 | S | 4/1965 | Smith |
| 3,207,456 | A | 9/1965 | Hill |
| 4,014,477 | A | 3/1977 | Hyun |
| 4,141,479 | A | 2/1979 | Dennison |
| D285,901 | S | 9/1986 | Gustavsson |
| 4,821,880 | A | 4/1989 | Ditton |

(Continued)

FOREIGN PATENT DOCUMENTS

| | | |
|---|---|---|
| AU | 327759 | 9/2009 |
| DE | 195 10 427 | 9/1996 |

(Continued)

OTHER PUBLICATIONS

International Search Report for PCT/EP2009/001487 (Form PCT/ISA/210.).

*Primary Examiner* — William E Dondero
(74) *Attorney, Agent, or Firm* — Merchant & Gould P.C.

(57) ABSTRACT

The invention relates to a device (10) for dispensing a telecommunication cable (12) from a reel (14), wherein the device (10) comprises the following: a first and a second end element that are separated by one or more transverse elements (20*a*, 20*b*, 20*c*, 20*d*); and an axis (22) that extends at least partially between the end elements (16, 18) so as to rotatably connect the reel (14) to the device, wherein the cable can be pulled from the reel over one of the one or more transverse elements.

23 Claims, 9 Drawing Sheets

(56) References Cited

U.S. PATENT DOCUMENTS

| | | | |
|---|---|---|---|
| 4,842,211 | A | 6/1989 | Robbins |
| 5,046,677 | A | 9/1991 | Loewe et al. |
| 5,184,743 | A | 2/1993 | Suzuki et al. |
| D367,575 | S | 3/1996 | Thompson |
| 5,598,985 | A | 2/1997 | Winesett |
| 5,897,075 | A | 4/1999 | Elder et al. |
| 5,954,294 | A | 9/1999 | Forsner |
| 5,967,451 | A | 10/1999 | Radaios |
| 6,016,911 | A | 1/2000 | Chen |
| 6,234,421 | B1 | 5/2001 | Cox et al. |
| 6,398,154 | B1 | 6/2002 | Cox et al. |
| 6,523,777 | B2 | 2/2003 | Gaudio |
| 6,705,564 | B2 | 3/2004 | Bootsman et al. |
| 6,834,827 | B2 | 12/2004 | Burkitt |
| 6,913,145 | B2 | 7/2005 | Barton et al. |
| 7,309,038 | B2 | 12/2007 | Carroscia |
| 7,311,285 | B2 | 12/2007 | Rauch et al. |
| D586,203 | S | 2/2009 | Zhang |
| D600,098 | S | 9/2009 | Allwood |
| 2006/0196794 | A1 | 9/2006 | Nicklas |
| 2006/0273217 | A1 | 12/2006 | Wilkinson |

FOREIGN PATENT DOCUMENTS

| | | |
|---|---|---|
| JP | 61-41165 | 3/1986 |
| JP | 6-144714 | 5/1994 |
| JP | 10-279194 | 10/1998 |

DEVICE FOR DISPENSING A TELECOMMUNICATION CABLE FROM A REEL

This application is a National Stage Application of PCT/EP2009/001487, filed 3 Mar. 2009, which claims benefit of Serial No. 2008902701, filed 29 May 2008 in Australia and which applications are incorporated herein by reference. To the extent appropriate, a claim of priority is made to each of the above disclosed applications.

TECHNICAL FIELD OF THE INVENTION

The present invention relates to an assembly for dispensing telecommunications cable from a reel.

BACKGROUND OF THE INVENTION

A number of systems have been developed for packaging and dispensing wound flexible media, such as telecommunications cable. For example, current packaging includes a cardboard box with internal plastic supports for rotatably mounting a reel of cable. A difficulty with the cardboard packaging is that is may not be sufficiently strong to permit palletisation and support the weight of the same product stacked on top of it. Further, the packaging may not lend itself to easy handling and maneuvering in environments with limited space, for example.

Cardboard cartons permit cable to be removed from the front of the box, for example. However, the cardboard packaging does not typically permit the reel to be viewed as cable is being dispensed and, consequently, the operator may not be able to see how the cable is feeding off the reel. Further, existing cardboard packages have limitations particularly when it is desirable to draw cable from multiple packages. In an installation where bundles of up to 12 cables are being installed, for example, the cartons are typically stacked in a 3×4 configuration and can be quite unstable when the cable is pulled. Due to the nature of the product and the regular surface of the cardboard, extra means are usually needed to make the stack of reels stable.

Other dispensing systems have been developed with a view to overcoming the above described difficulties. For example, with reference to FIG. 1, U.S. Pat. No. 6,523,777 teaches a portable wire spool caddy that includes a frame (12) with end plates (14, 16) separated by rectangular supporting members (18, 20). The caddy is shaped to house a reel (42) between the support members (18, 20) and the plates (14, 16) in a manner that permits the reel (42) to spin as cable is drawn therefrom. The caddy also includes a swing (80) and bracket (54) which is adapted to bear against the reel (42) and function as a braking mechanism. The wire spool caddy taught by U.S. Pat. No. 6,523,777 may provide a useful device for generally dispensing cable. However, the wire spool caddy may not provide a tie-off mechanism for securing an end of the cable with respect to the caddy. Further, U.S. Pat. No. 6,523,777 may not provide a mechanism that can tie-off an end of the cable and stop the reel (42) from rotating due to inertia during transportation.

Similarly, U.S. Pat. No. 5,967,451 teaches a carrier for carrying one or more wire spools. With reference to FIG. 1 of U.S. Pat. No. 5,967,451, the carrier includes end plates (26, 28) connected by a central rod (20), connecting rods (48, 50) and handle (46). The carrier includes a semicircular cradle (24) arranged to support the wire spools (12, 14) and to protect them from "free wheeling" in which the spools continue to spin after the user has ceased pulling the wire from the spools. The cradle (24) includes a number of slots (36), one for each spool, through which wire is drawn from the spools (12, 14). The cradle taught by U.S. Pat. No. 5,967,451 may provide a useful device for generally dispensing cable. However, the cradle may not provide a tie-off mechanism for securing an end of the cable with respect to the cradle. Further, U.S. Pat. No. 5,967,451 may not provide a mechanism that can stop the wire spool (12, 14) from rotating due to inertia during transportation.

It is generally desirable to overcome or ameliorate one or more of the above mentioned difficulties, or at least provide a useful alternative.

SUMMARY OF THE INVENTION

In accordance with one aspect of the invention, there is provided an assembly for dispensing telecommunications cable from a reel, including:

(a) first and second end members separated by one or more cross-members; and (b) an axle extending at least partially between the end members for rotatably coupling the reel to the assembly, wherein cable can be drawn from the reel over one of said one or more cross-members.

Preferably, the assembly includes a brake coupled to the first end member of said end members, wherein the brake is adapted to receive a section of the cable and inhibit movement of the section of the cable with respect to the first end member.

Preferably, the brake defines a slot adapted to receive and resiliently bear against a lateral section of cable so as to inhibit longitudinal movement of said lateral section of the cable with respect to the first end member.

Preferably, the brake at least partially elastically deforms as the lateral section of the cable is received in the slot and thereby resiliently bears against the reel to inhibit rotation of the reel about the axle.

Preferably, the slot is defined between a convex section of the brake seated at least partially within a corresponding concave section of the brake.

Preferably, the convex section is adapted to move relative to the concave section as the lateral section of the cable is forced into the slot.

Preferably, the convex section is adapted to resiliently bear against the reel coupled to the axle during said relative movement to inhibit rotation of the reel about the axle.

Preferably, the convex section includes a boss shaped to engage corresponding grooves of the reel during said relative movement to inhibit rotation of the reel about the axle.

Preferably, the brake is formed integrally with a generally planar section of the first end member.

Advantageously, preferred embodiments of the invention provide a robust assembly for packaging and dispensing telecommunications cable that permits palletisation.

Advantageously, preferred embodiments of the invention provide a useful assembly for dispensing telecommunications cable, for example. Further, preferred embodiments of the invention advantageously provide an assembly which operates to tie off end sections of cable. Further still, preferred embodiments of the invention advantageously operate to prevent a reel from rotating about an axle when the cable has been tied off.

BRIEF DESCRIPTION OF THE DRAWINGS

Preferred embodiments of the present invention are hereafter described, by way of non-limiting example only, with reference to the accompanying drawings in which.

DETAILED DESCRIPTION OF PREFERRED EMBODIMENTS OF THE INVENTION

Figure 1:
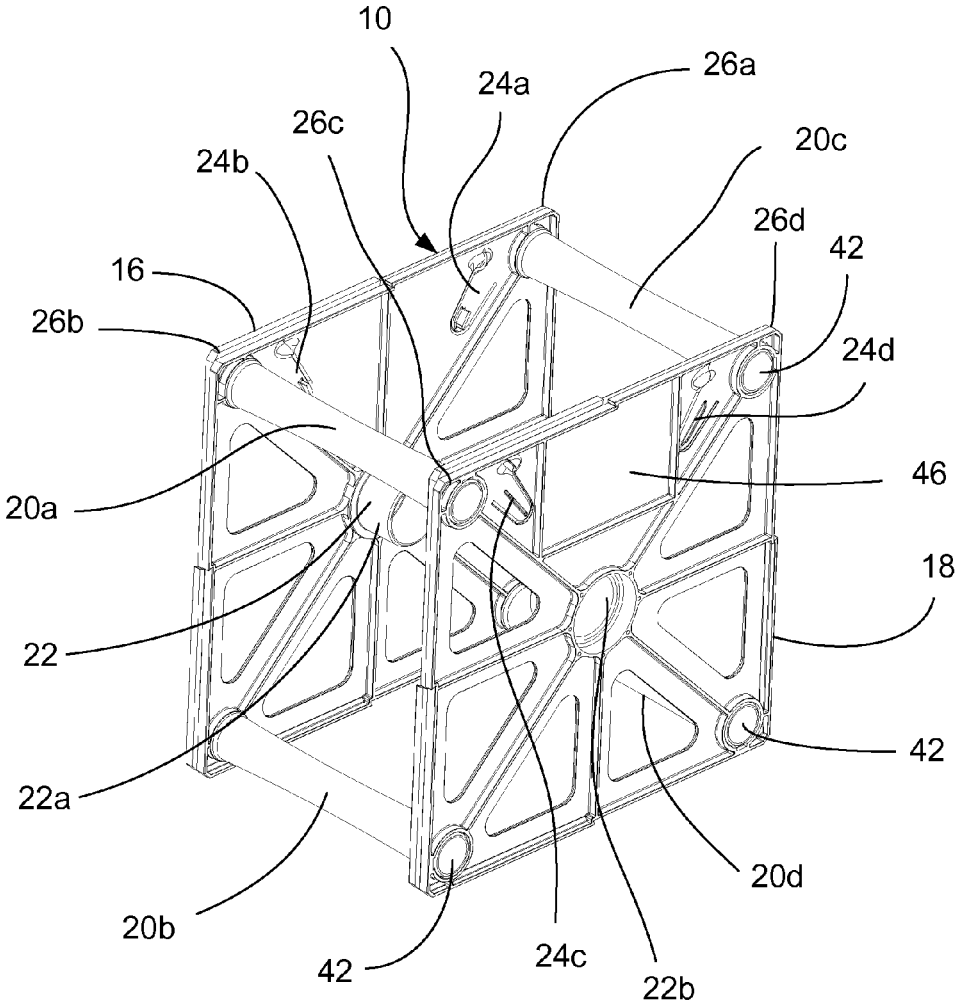
FIG. 1 is a perspective view of an assembly for dispensing telecommunications cable from a reel.

The assembly 10 sown in FIGS. 1 to 5 is used to dispense telecommunications cable 12, for example, from a reel 14. The assembly 10 includes first and second end members 16, 18 separated by one or more cross-members 20*a*, 20*b*, 20*c*, 20*d*. The assembly also includes an axle 22 extending at least partially between the end members 16, 18 for rotatably coupling the reel 14 to the assembly 10. The assembly also includes a brake coupled to the first end member 16. The brake 24 is adapted to receive a section of the cable 12 and inhibit movement of the section of the cable 12 with respect to the first end member 16. The assembly 10 is used as packaging for the reel 14 of telecommunications cable 12.

The assembly 10 is adapted to function as robust packaging for the reel of cable 12. The assembly 10 is strong enough to permit palletisation. The brake 24 of the assembly 10 operates to tie off end sections of cable 12. The brake also operates to prevent the reel 14 from rotating about the axle 22 when the cable 12 has been tied off.

In the example shown, the end members 16, 18 are generally planar square plates that permit uniform stacking in different orientations. The assembly 10 includes four elongate cross-members 20*a*, 20*b*, 20*c*, 20*d* and the axle 22 is formed in two parts 22*a*, 22*b*, each extending normally away from central sections of respective opposed sides of the end members 16, 18. The reel 14 is be supported between the two parts 22*a*, 22*b* of the axle 22 and adapted to rotate freely there around. As illustrated, the assembly 10 includes four brakes 24*a*, 24*b*, 24*c*, 24*d* operatively coupled to respective corners 26*a*, 26*b*, 26*c*, 26*d* of the end members 16, 18. The brakes 24*a*, 24*b*, 24*c*, 24*d* operate independently to tie off end sections of cable 12. The brakes 24*a*, 24*b*, 24*c*, 24*d* also independently operate to prevent the reel 14 from rotating about the axle 22 when the cable 12 has been tied off.

Figure 3:
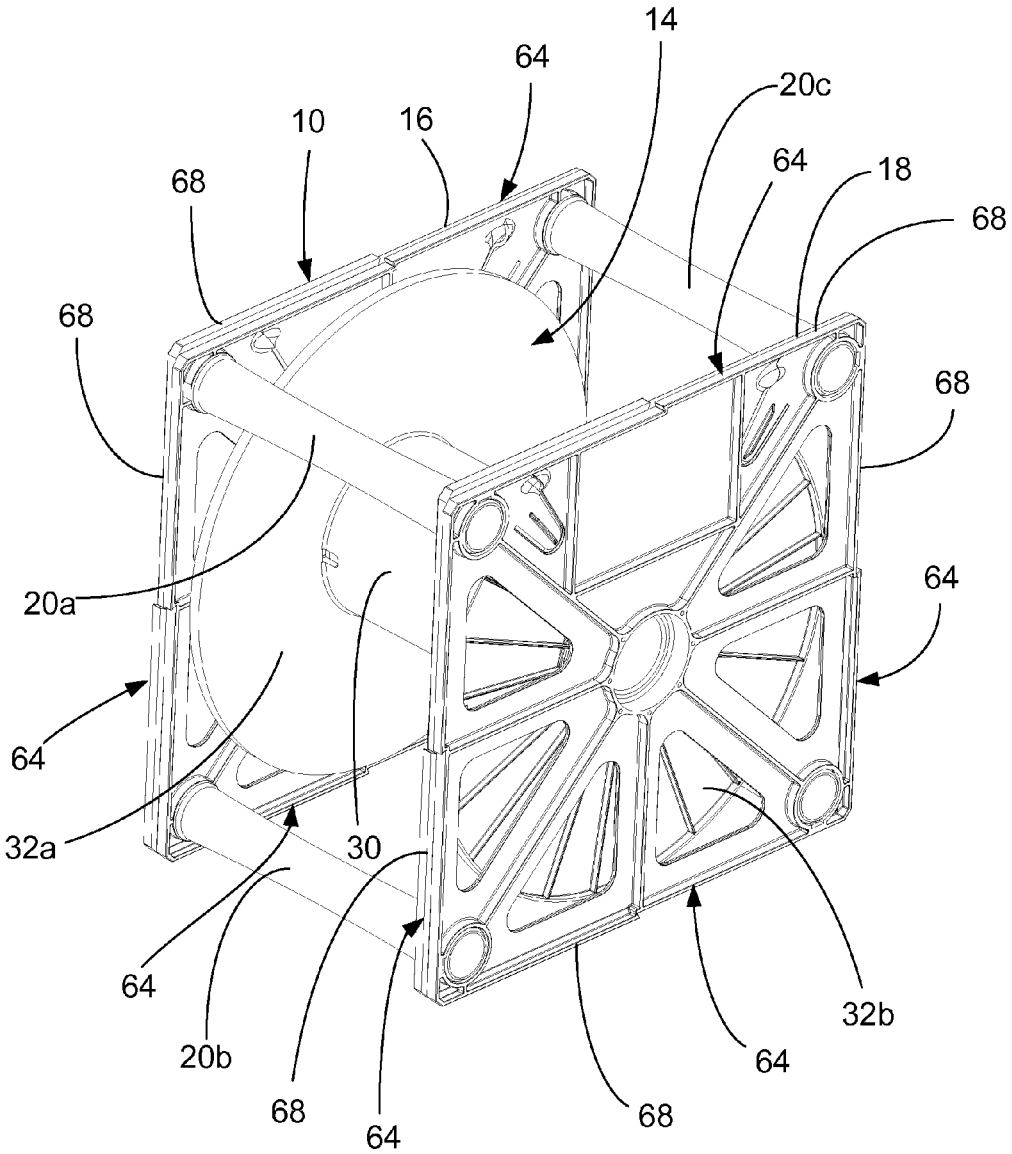
FIG. 3 is a perspective view of the assembly shown in FIG. 1 coupled to a reel.
Figure 4:
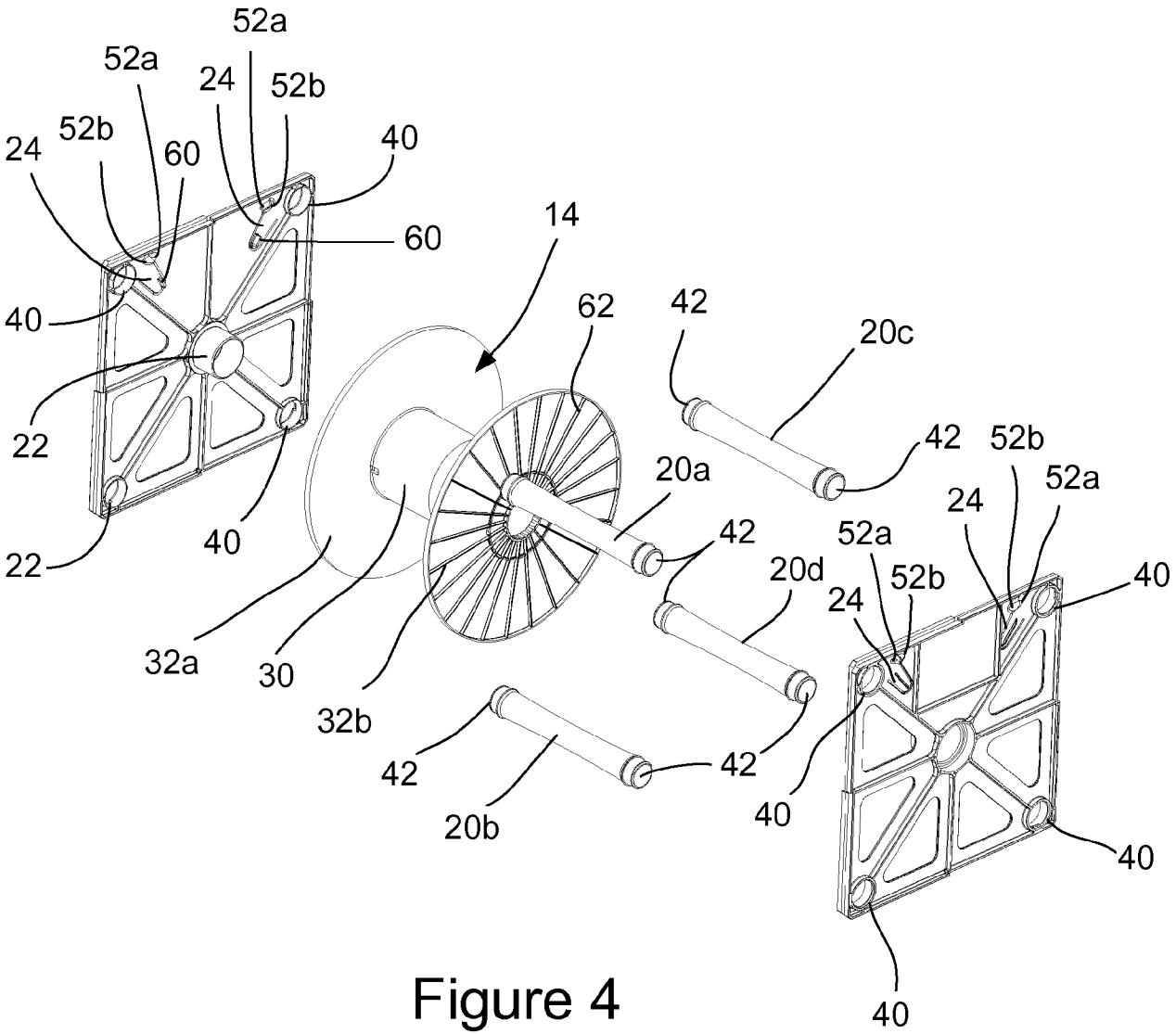
FIG. 4 is an exploded perspective view of the assembly shown in FIG. 3.

As particularly shown in FIGS. 3 and 4, the reel 14 includes a hollow cylindrical spool 30 coupled between two annular end plates 32*a*, 32*b*. The reel 14 is adapted to have a flexible medium 12, such as telecommunications cable 12, wound around the spoon 30. The external diameter of the annular end plates 32*a*, 32*b* is greater than the external diameter of the hollow cylindrical spool so that the annular end plates 32*a*, 32*b* confine the flexible medium 12 to being wound around the spool 30 only. The internal diameter of the annular end plates 32*a*, 32*b* approximates that of the internal diameter of the hollow cylindrical spool 30 which, in turn, is slightly greater than the diameter of the axle 22. As such, the reel can be mounted on the assembly by seating the two parts 22*a*, 22*b* of the axle 22 inside respective ends of the hollow cylindrical spool 30.

Figure 2:
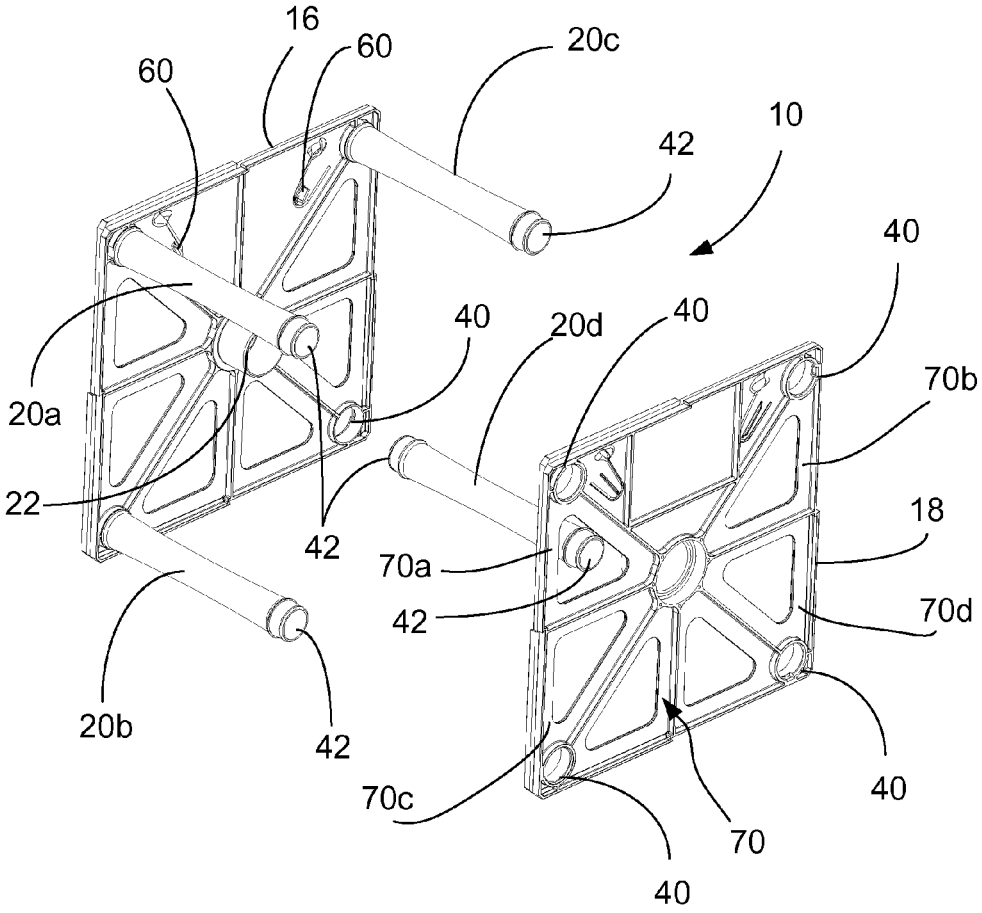
FIG. 2 is a partially exploded perspective view of the assembly shown in FIG. 1.
Figure 5:
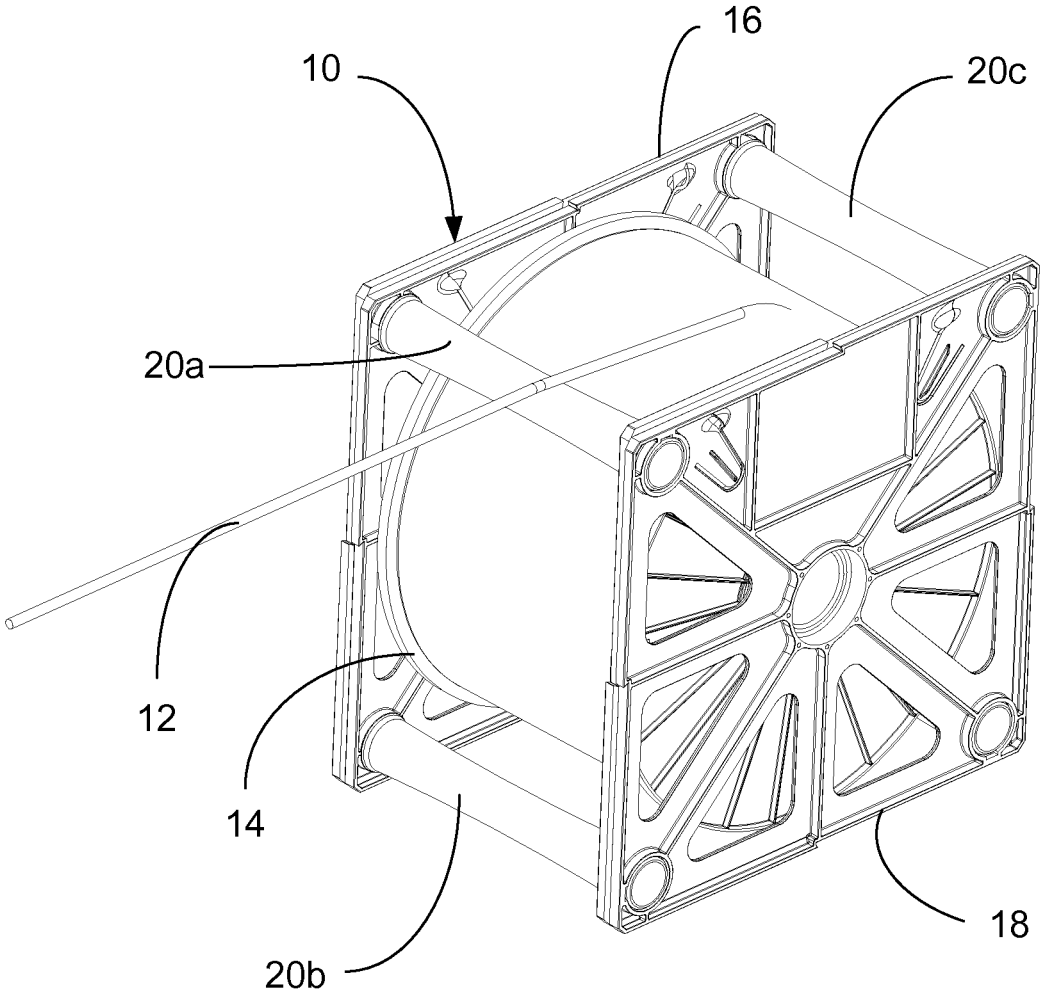
FIG. 5 is a perspective view of the assembly shown in FIG. 1 coupled to a reel including telecommunications cable.

As particularly shown in FIGS. 2 and 5, the cross-members 20*a*, 20*b*, 20*c*, 20*d* are adapted for releasable engagement with the end members 16, 18. In the example shown, the corners 26*a*, 26*b*, 26*c*, 26*d* of the square end members 16, 18 include circular apertures 40 shaped to receive corresponding end sections 42 of the cylindrical cross-members 20*a*, 20*b*, 20*c*, 20*d*. The diameter of the end sections 42 of the cylindrical cross-members 20*a*, 20*b*, 20*c*, 20*d* is slightly less than the diameter of the circular apertures 40 so that end sections 42 resiliently bear against the internal periphery of the apertures 40 and are thereby coupled together by frictional engagement. The cross-members 20*a*, 20*b*, 20*c*, 20*d* are preferably secured to respective apertures 40 without the need for mechanical fasteners or adhesives. The cross-members 20*a*, 20*b*, 20*c*, 20*d* are preferably releasably secured to respective apertures 40 so that the assembly can be dismantled for reuse or disposal. The cross-members 20*a*, 20*b*, 20*c*, 20*d* are clipped into position to allow the reel 14 to be interchanged.

The inner peripheral surface of each aperture 40 includes a slot 44 shaped to receive a lever, such as the spade of a screw driver, to assist in urging the end sections 42 out of corresponding apertures 40.

The hollow cross-members 20*a*, 20*b*, 20*c*, 20*d* of the assembly are adapted to receive string or rope there through to tie a stack of assemblies 10 together.

The cross-members 20*a*, 20*b*, 20*c*, 20*d* are sufficiently strong and are of suitable dimensions to function as handles. The end members 16, 18 are sufficiently strong and rigid to allow the assembly 10 to be palletised and support the weight of the same assembly 10 stacked on top of it.

The end members 16, 18 each include predetermined areas 46 adapted to bear indicia for labelling the assembly 10. The predetermined areas 46 preferably can be written on with a felt tipped pen or ballpoint pen, for example. Alternatively, the predetermined areas 46 are adapted to receive a sticker, for example, bearing indicia for labelling the assembly 10.

Figure 6:
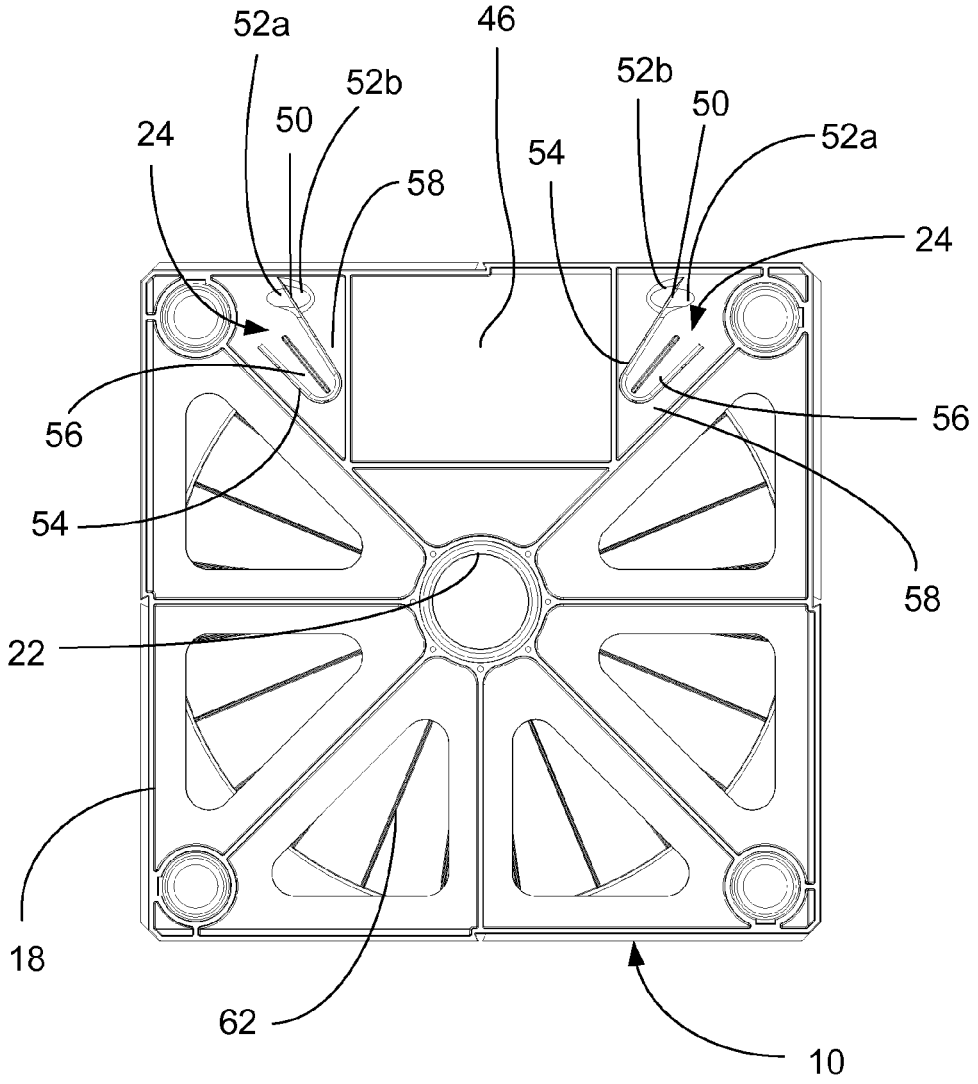
FIG. 6 is a side view of the assembly shown in FIG. 3.
Figure 7:
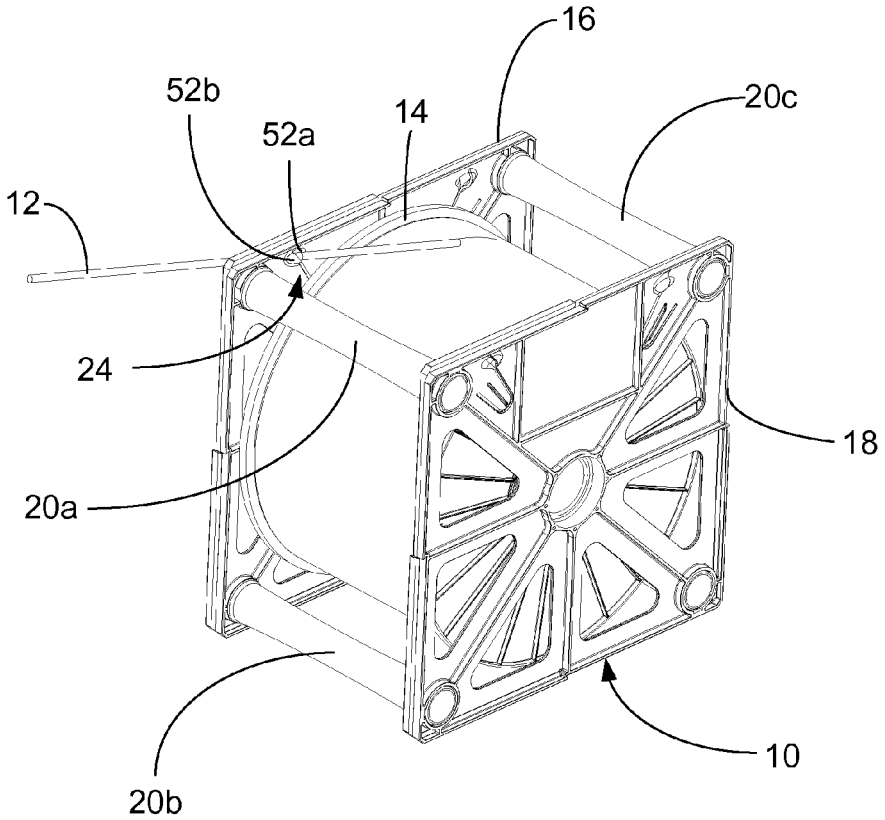
FIG. 7 is a perspective view of the assembly shown in FIG. 5 coupled to a reel including telecommunications cable arranged in another condition of use.

As particularly shown in FIGS. 6 and 7, the brake 24 defines an aperture 50 through which cable 12 can be drawn from the reel 14. The aperture 50 extends through the end members 16, 18 so that the cable 12 is threaded through the end members 16, 18. Both the internal and external section of the apertures 50 includes corresponding concave and convex hoods 52*a*, 52*b* that cooperate to receive corresponding sides of the cylindrical telecommunications cable 12 there between at an acute angle. The hoods 52*a*, 52*b* permit the cable to slide through the aperture 50 without significantly bending the cable 12 away from its direction of extent from the spool 30.

The brake 24 also defines a slot 54 adapted to receive and resiliently bear against a lateral section of cable so as to inhibit longitudinal movement of said lateral section of the cable 12 with respect to the end member 16, 18. Further, the brake 24 at least partially elastically deforms as the lateral section of the cable 12 is received in the slot 54 and thereby resiliently bears against the reel 14 to inhibit rotation of the reel 14 about the axle 22. The slot 54 preferably opens into the aperture 50 so that a longitudinal section of cable threaded through the aperture can be forced into the slot 54. Alternatively, the slot 54 opens into the top of the end member 16, 18 so that a longitudinal section of cable threaded through the aperture can be forced into the slot 54.

Figure 8:
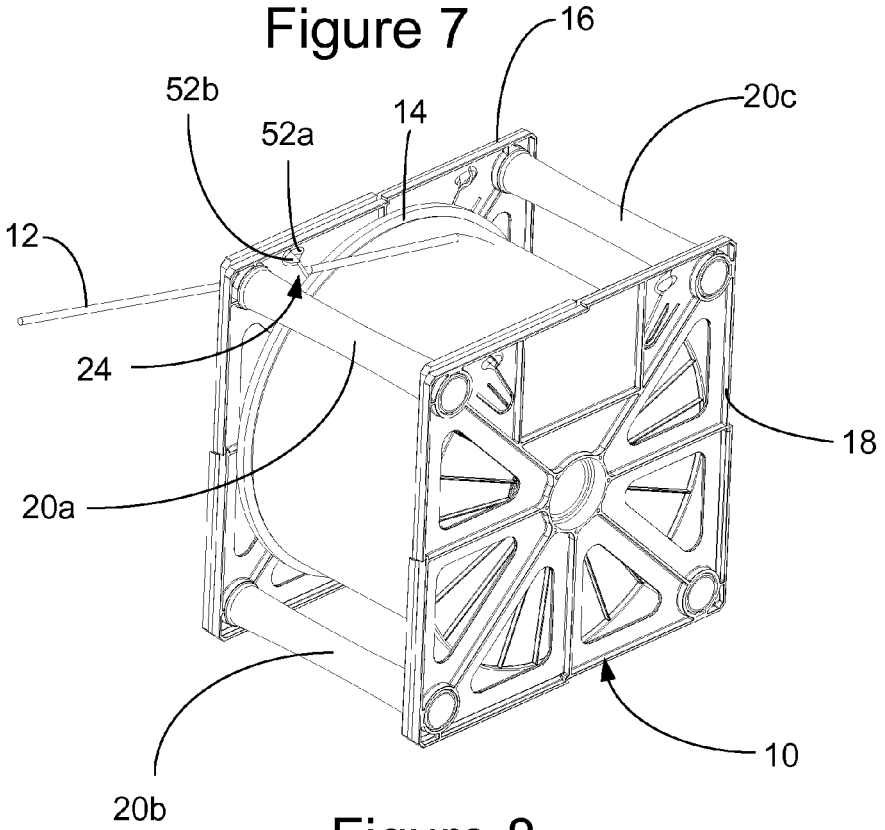
FIG. 8 is a perspective view of the assembly shown in FIG. 5 coupled to a reel including telecommunications cable arranged in yet another condition of use.

The slot 54 is defined between a convex section 56 of the brake 24 seated at least partially within a corresponding concave section 58 of the brake 24. The convex section 56 is adapted to deform and move relative to the concave section 58 as the lateral section of the cable 12 is forced into the slot 54. As particularly shown in FIG. 8, the convex section 56 is adapted to resiliently bear against the reel 14 coupled to the axle 22 during the described relative movement to inhibit rotation of the reel 14 about the axle 22. The convex section 56 preferably includes a boss 60 shaped to engage corresponding radial grooves 62 of the reel 14 as a result of the described relative movement to inhibit rotation of the reel 14 about the axle 22. Alternatively, the boss 60 is shaped to engage corresponding radial ribs 62 of the reel 14 as a result of the described relative movement to inhibit rotation of the reel 14 about the axle 22.

The brake 24 is preferably formed integrally with a generally planar section of the end member 16, 18.

As particularly shown in FIG. 3, the end members 16, 18 include fasteners 64 for cooperative operation with corresponding fasteners 64 of end members 16, 18 of other like assemblies 10. The fasteners 64 permit stacking of the assembly 10 with other like assemblies 10. The fasteners 64 provide positive location in both sideways and longitudinal directions. In the example shown in FIGS. 1 to 8, the fasteners 64 are formed on all 4 edges of the end members 16, 18. On each edge, the fastener 64 includes a mating surface 68 for interlocking with a corresponding surface 68 of another assembly 10. The surface 68 is adapted to side to side and back and forth movement between stacked assemblies 10, for example. In the example shown, the surface 68 of each edge of the end members 16, 18 is partly raised and partly stepped down to mate with a corresponding surface 68 of another assembly 10 which is partly stepped down and partly raised. The surfaces 68 of the two assemblies 10 are preferably corresponding mating surfaces.

The above described arrangement of the assembly 10 allows for cable 12 to be pulled out from the top reel over a cross-member 20. Cable 12 can thereby be dispensed in various orientations to suit the space available. As particularly shown in FIG. 9, an upper assembly 10 of a stack of assemblies 10 can be inverted and dispensed in a manner whereby force applied to the reel 14 is acting at a lower level and, as such, the stack is more stable.

Figure 9:
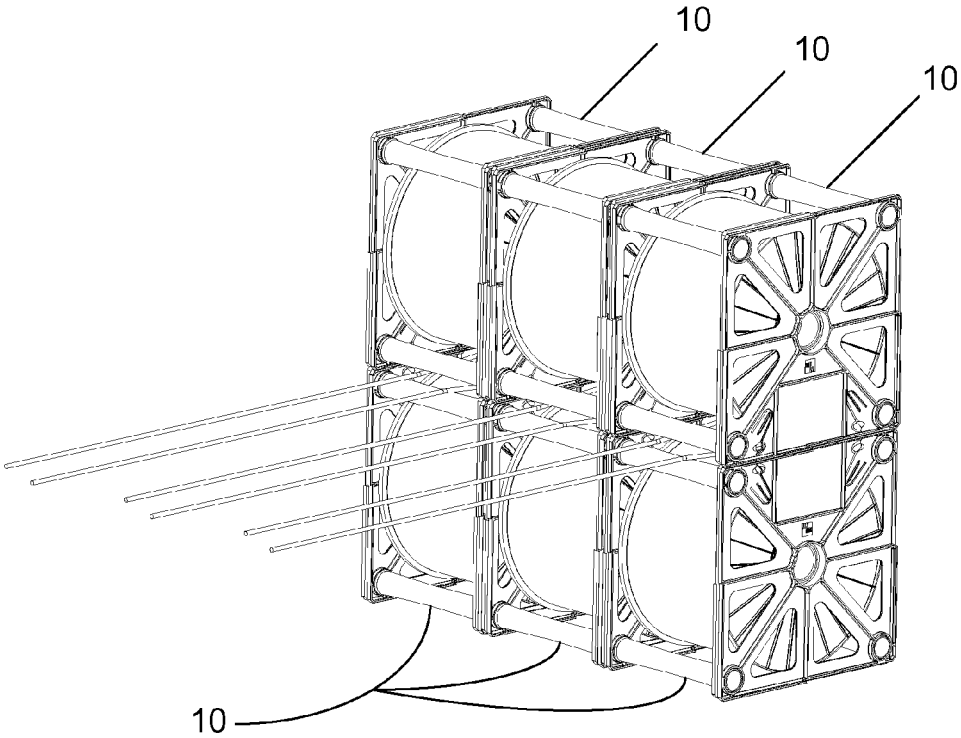
FIG. 9 is a perspective view of a plurality of assemblies of the type shown in FIG. 5 stacked together in a first arrangement.
Figure 10:
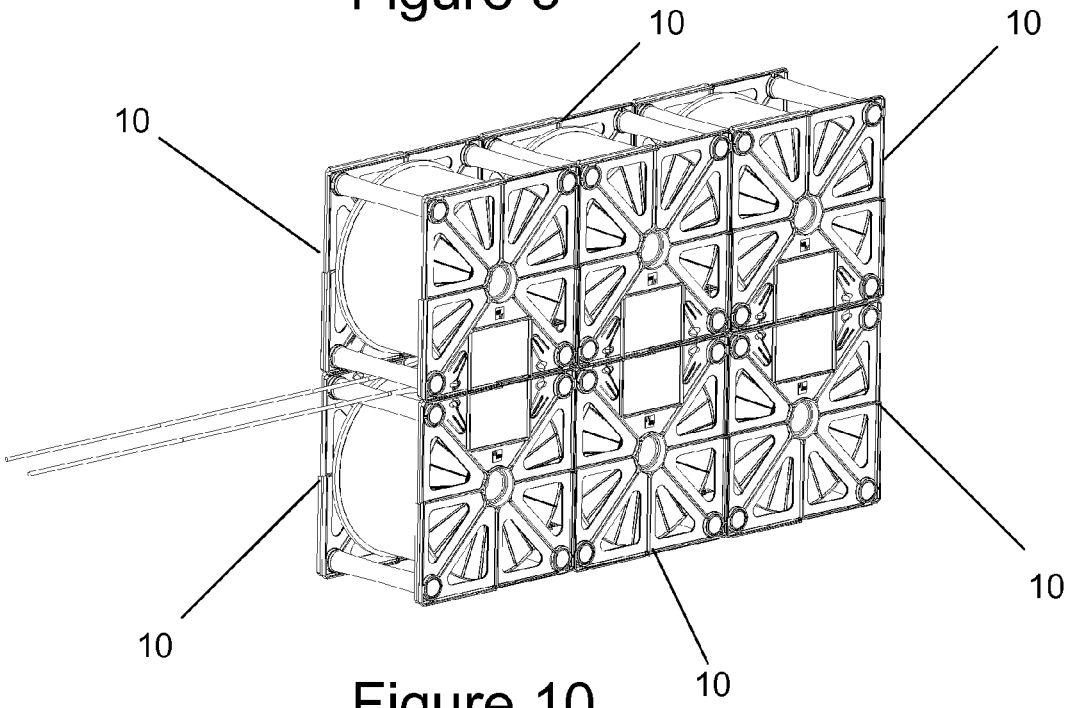
FIG. 10 is a perspective view of a plurality of assemblies of the type shown in FIG. 5 stacked together in a second arrangement.
Figure 11:
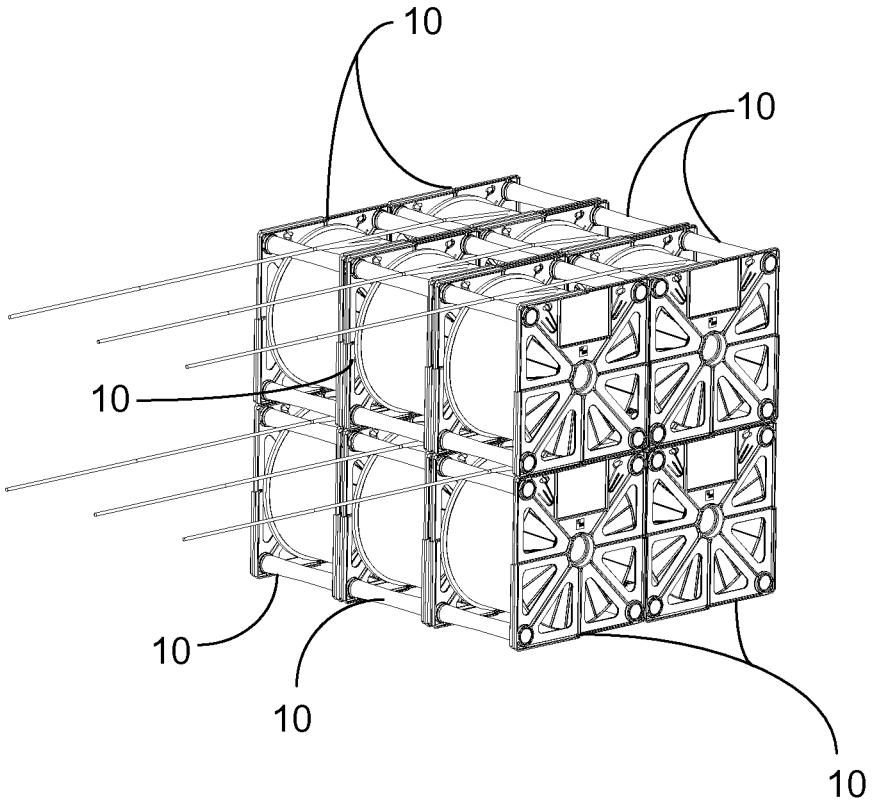
FIG. 11 is a perspective view of a plurality of assemblies of the type shown in FIG. 5 stacked together in a third arrangement.

Unlike cardboard box based dispensing systems, the assembly 10 supports the reel 14 in a manner that provides clearance between cross-members 20. As such, a stack can be arranged in a lower and longer arrangement due to increased stability. A combination of stacking orientations, as shown in FIGS. 9 to 11, produces a more stable and compact stack. Further, the cross members 20 do not include jag points to catch the cable unintentionally.

As particularly shown in FIG. 2, the exterior side of each end member 16, 18 includes nesting features 70 to limit movement between assemblies 10 when arranged in a stack. For example, each exterior side surface is divided into four quadrants 70*a*, 70*b*, 70*c*, 70*d* with pairs 70*a*, 70*d* and 70*b*, 70*c* of raised and lowered diagonal quadrants. When two assemblies 10 are set beside each other, the raised quadrant of one is seated in a lowered quadrant of the other, and vice versa. The coupling of the end members 16, 18 of side by side assemblies 10 inhibits relative movement therebetween in both lateral and longitudinal directions.

A stack of assemblies 10 can be further stabilised by tying the stack together by threading string, for example, through the hollow cross-members 20. The axle 22 is preferably hollow so that the stack of assemblies can be further stabilised by threading a rope or water pipe through adjacent hollow axles.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

Throughout this specification, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that the prior art forms part of the common general knowledge in Australia.

LIST OF PARTS

Assembly 10
Cable 12
Reel 14
End member 16
End member 18
Cross member 20*a*, 20*b*, 20*c*, 20*d*
Axle 22
Brake 24, 24*a*, 24*b*, 24*c*, 24*d*
Corner 26*a*, 26*b*, 26*c*, 26*d*
Spool 30
Annular plate 32*a*, 32*b*
Aperture 40
End section 42
Slot 44
Area 46
Aperture 50
Concave hood 52*a*
Convex hood 52*b*
Slot 54
Convex section 56
Concave section 58
Boss 60
Groove 62
Fastener 64
Mating surface 68
Nesting features 70
Quadrant 70*a*, 70*b*, 70*c*, 70*d*

The invention claimed is:

1. An assembly for dispensing telecommunications cable from a reel, comprising:

(a) first and second end members separated by one or more cross-members; and (b) an axle extending at least partially between the end members for rotatably coupling the reel to the assembly, wherein cable can be drawn from the reel over one of said one or more cross-members;

(c) wherein the first and second end members each define an aperture, the apertures including concave and convex hoods adapted to receive the cable and permit the cable to slide through the aperture without bending the cable, wherein the aperture is configured to tie off the cable received therebetween.

2. The assembly claimed in claim 1, including a brake coupled to the first end member of said end members, wherein the brake is adapted to receive a section of the cable and inhibit movement of the section of the cable with respect to the first end member.

3. The assembly claimed in claim 2, wherein the brake defines a slot adapted to receive and resiliently bear against a lateral section of the cable so as to inhibit longitudinal movement of said lateral section of the cable with respect to the first end member.

4. The assembly claimed in claim 2, wherein the brake is formed integrally with a generally planar section of the first end member.

5. The assembly claimed in claim 1, wherein the axle includes two centrally disposed axles extending normally away from respective end members to support the reel therebetween.

6. The assembly claimed in claim 1, wherein the cross members are elongate.

7. The assembly claimed in claim 1, wherein the cross members are hollow tubular members open at both ends.

8. The assembly claimed in claim 1, wherein the cross members are releasably couplable to the end members.

9. The assembly claimed in claim 1, wherein the cross members are sufficiently strong to function as handles.

10. The assembly claimed in claim 1, wherein the end members are generally planar parallelograms.

11. The assembly claimed in claim 10, wherein the end members include fasteners for cooperative operation with corresponding fasteners of end members of another assembly.

12. The assembly claimed in claim 11, wherein the fasteners permit stacking of the assembly and said other assembly.

13. The assembly claimed in claim 12, wherein the fasteners provide positive location in both sideways and longitudinal directions.

14. The assembly claimed in claim 1, wherein the end members are sufficiently strong and rigid to allow the assembly to be palletised and support the weight of the same product stacked on top of the end members.

15. The assembly claimed in claim 1, wherein at least one of the end members includes a generally flat section for bearing indicia.

16. The assembly claimed in claim 1, wherein the assembly is used as packaging for the reel.

17. An assembly for dispensing telecommunications cable from a reel, comprising:

(a) first and second end members separated by one or more cross-members;

(b) an axle extending at least partially between the end members for rotatably coupling the reel to the assembly, wherein cable can be drawn from the reel over one of said one or more cross-members; and (c) a brake coupled to the first end member of said end members, wherein the brake is adapted to receive a section of the cable and inhibit movement of the section of the cable with respect to the first end member, wherein the brake defines a slot adapted to receive and resiliently bear against a lateral section of cable so as to inhibit longitudinal movement of said lateral section of the cable with respect to the first end member, and wherein the brake at least partially elastically deforms as the lateral section of the cable is received in the slot and thereby resiliently bears against the reel to inhibit rotation of the reel about the axle.

18. The assembly claimed in 17, wherein the slot is defined between a convex section of the brake seated at least partially within a corresponding concave section of the brake.

19. The assembly claimed in claim 18, wherein the convex section is adapted to move relative to the concave section as the lateral section of the cable is forced into the slot.

20. The assembly claimed in claim 17, wherein the brake also defines an aperture through which cable can be drawn from the reel.

21. The assembly claimed in claim 20, wherein a first end of the slot opens into said aperture so that a longitudinal section of cable threaded through the aperture can be forced into the slot.

22. An assembly for dispensing telecommunications cable from a reel, comprising:

(a) first and second end members separated by one or more cross-members;

(b) an axle extending at least partially between the end members for rotatably coupling the reel to the assembly, wherein cable can be drawn from the reel over one of said one or more cross-members; and (c) a brake coupled to the first end member of said end members, wherein the brake is adapted to receive a section of the cable and inhibit movement of the section of the cable with respect to the first end member;

wherein the brake defines a slot adapted to receive and resiliently bear against a lateral section of cable so as to inhibit longitudinal movement of said lateral section of the cable with respect to the first end member;

wherein the slot is defined between a convex section of the brake seated at least partially within a corresponding concave section of the brake;

wherein the convex section is adapted to move relative to the concave section as the lateral section of the cable is forced into the slot; and wherein the convex section is adapted to resiliently bear against the reel coupled to the axle during said relative movement to inhibit rotation of the reel about the axle.

23. The assembly claimed in claim 22, wherein the convex section includes a boss shaped to engage corresponding grooves of the reel during said relative movement to inhibit rotation of the reel about the axle.

* * * * *